United States Patent [19]

Samuel et al.

[11] Patent Number: 5,045,594

[45] Date of Patent: Sep. 3, 1991

[54] CONTAINER CLOSURES AND SEALED CONTAINERS

[75] Inventors: David N. Samuel, Great Gransden, Nr. Sandy; Richard S. Williams, Impington, both of England

[73] Assignee: W. R. Grace & Co.-Conn., New York, N.Y.

[21] Appl. No.: 370,548

[22] Filed: Jun. 23, 1989

[30] Foreign Application Priority Data

Jun. 29, 1988 [GB] United Kingdom ..... 8815486
Aug. 26, 1988 [GB] United Kingdom ..... 8820282

[51] Int. Cl.[5] ..... C08L 23/12; C08L 29/04; B65D 41/00

[52] U.S. Cl. ..... 525/57; 428/35.7; 428/64; 426/106; 215/316

[58] Field of Search ..... 525/57; 428/36.8, 35.7, 428/64

[56] References Cited

U.S. PATENT DOCUMENTS

| | | | |
|---|---|---|---|
| 3,524,905 | 8/1970 | Coates | 525/57 |
| 3,857,754 | 12/1974 | Hirata et al. | 161/227 |
| 3,931,449 | 1/1976 | Hirata et al. | 428/483 |
| 3,975,463 | 8/1976 | Hirata et al. | 260/897 |
| 4,568,529 | 2/1986 | Leconte | 525/57 |

FOREIGN PATENT DOCUMENTS

| | | |
|---|---|---|
| 0142183 | 9/1984 | European Pat. Off. . |
| 0153068 | 2/1986 | European Pat. Off. . |
| 0215671 | 9/1986 | European Pat. Off. . |
| 219265 | 4/1987 | European Pat. Off. . |
| 0129309 | 8/1988 | European Pat. Off. . |
| 62-263250 | 11/1987 | Japan . |
| 1112025 | 5/1978 | United Kingdom . |
| 2158383 | 5/1984 | United Kingdom . |
| 2158423 | 5/1984 | United Kingdom . |
| 2180521 | 9/1985 | United Kingdom . |

*Primary Examiner*—Carman J. Seccuro
*Attorney, Agent, or Firm*—John Dana Hubbard: William L. Baker

[57] ABSTRACT

A preformed container closure element, preferably a cap, is formed of a polymeric matrix containing an ethylene vinyl alcohol polymer to reduce oxygen permeability of the cap. The cap is of special value for sealing filled jars or bottles, especially of glass, wherein the filling is beer.

14 Claims, No Drawings

CONTAINER CLOSURES AND SEALED CONTAINERS

This invention relates to materials that can be used to improve the shelf life of packaged materials, such as bottled beer.

It is known to form packages for food and other materials by use of laminated polymeric material, generally including a barrier layer of low permeability to oxygen, and that may be formed of, for instance, a blend of polypropylene and ethylene vinyl alcohol (see for instance EP 142183). These packages are generally flexible.

Jars and bottles are much more rigid. They can be made of relatively thick and relatively impermeable polymeric material, for instance a polymeric material that includes a barrier layer. It is known from U.S. Pat. Nos. 3,857,754 and 3,975,463 to form articles such as bottles from certain compositions that include certain saponified ethylene-vinyl acetate copolymers. Often, however, the jar or bottle is made of glass.

The jar or bottle is provided with a closure. Traditionally the closure was of metal but there is a trend now toward forming the closure of polymeric material. A gasket of polymeric material can be provided between the polymeric closure and the jar or bottle.

Even when the body of the jar or bottle is wholly impermeable, e.g., of glass, and the polymeric cap makes an airtight fit with the jar or bottle, possibly through a gasket between the cap and the jar or bottle, it is well accepted that some deterioration of fillings such as beer may occur on storage due to the ingress of gases.

Although ingress of oxygen is a main cause of deterioration of beer, off-flavours can also arise when the container is exposed to an atmosphere containing other gases that can give an unpleasant flavour. For instance the containers are sometimes packed on pallets or in crates made of wood that has been impregnated with a preservative that may result in the atmosphere being contaminated with chloroanisole and it is necessary to prevent ingress of this.

Accordingly it is well accepted that, when using polymeric caps for beer and other bottles, it is generally necessary to restrict the shelf life.

It would be very desirable to be able to improve the shelf life significantly whilst continuing to use conventional materials for the formation of the container body, the container closure and the gasket between the body and closure.

A product according to the invention comprises a container closure for closing a filled container body wherein the closure comprises a preformed element of polymeric composition and the oxygen permeability of the composition (measured on a preformed element formed from the composition) has been reduced by incorporation of ethylene vinyl alcohol polymer into the composition.

The preferred products of the invention are caps formed from the polymeric composition and filled jars or bottles (especially of glass) sealed with the caps.

The filling is normally beer, but can be any other material whose shelf life is restricted due to contamination during storage by oxygen or other gases.

The preformed solid element is preformed in the sense that it is applied to the closure or to the container as a previously manufactured form solid matrix and is not subsequently altered as by melting or flowing. This is in contrast to the invention described in our copending application GB 8815486.9 filed even date herewith in which a fluid or molten composition is applied on to a container closure to form, for instance, a solid gasket on that closure.

The closure occupies, as is conventional, only a minor part of the exposed surface of the closed container often less than 25% of the exposed surface area of the container. Thus the area of the solid element can be very small relative to the exposed area of the container. Despite this, the invention can give greatly improved storage stability.

The preformed element may constitute the entire closure or part only of the enclosure. If it is the entire closure, then the closure is normally a cap and the cap is formed of the polymeric matrix containing the ethylene vinyl alcohol polymer. The cap can be moulded with an integral seal or intended for use with an inserted disc gasket or with a gasket that is lined on to it from a molten or fluid composition.

If the element constitutes part only of the closure, it can be in the form of a panel that defines part of the closure. For instance the closure can be mainly of metal but can have a removable panel of polymeric material that can be torn out or otherwise ruptured in order to open the container.

Another closure element of the invention is a liner or other preformed disc that is fitted between the neck of the filled container and the remainder of the closure, which can be of metal.

The container body is preferably of metal or glass but can be of polymeric material.

In one preferred aspect of the invention, the container body is of glass or polymeric material (especially being a jar or bottle filled with beer) and the preformed solid element is a plastic cap for the jar or bottle.

The cap may be metal or may be polymeric. Thus it may be formed by, for instance, injection or compression moulding of a suitable thermoplastic composition that may contain, as a thermoplastic polymer, polyethylene, polypropylene, ethylene propylene copolymer, polystyrene, polyacetyl, polyethylene terephthalate or a blend of two or more of these. The composition from which the cap is made may include other conventional ingredients for such compositions, including anti-oxidants, slip aids and fillers, generally all in minor amounts. The oxygen permeability of the cap is often at least 2 cc STP/cm/cm$^2$/sec/cmHg$\times 10^{10}$, often 2 to 5.

In its simplest embodiment, a cap formed of such polymeric material and containing the polymer is the closure on a jar or bottle of glass or of polymeric material, such as polyethylene terephthalate or any of the other polymers mentioned above. When the body is formed of polymeric material, the oxygen permeability of the body may be substantially zero or may be higher, for instance at least 0.07, typically 0.07 to 2 cc STP/cm/cm$^2$/sec/cmHg$\times 10^{10}$.

The polymeric cap may be a crown cap, a twist-on cap or a screw cap or any other form of polymeric cap suitable for closing jars and containers.

Instead of or in addition to forming the cap of the polymeric matrix containing ethylene vinyl alcohol polymer, the cap or other closure may be provided with an inner liner or other preformed disc or ring of the matrix containing ethylene vinyl alcohol polymer. For instance the cap may be provided with a preformed internal disc of polymeric matrix containing ethylene vinyl alcohol polymer or a polymeric film of such a matrix may be sealed across the open top of the jar. The disc or ring is introduced in its final form and may be held loosely in the cap or it may be trapped in the cap by appropriate shaping of the inner face of the cap.

This preformed disc or ring may, in some instances, serve as a satisfactory gasket between the closure and the container body. For instance it may be a butyl rubber or other polymeric ring of the type used as a gasket in baby-food jars.

When the disc or ring is not a gasket, then a gasket of polymeric material may be provided between the closure and container body. This gasket may be of conventional material or, as described in copending application GB 8815486.9 the gasket may be formed on the closure from a fluid or meltable composition that comprises polymeric matrix material and ethylene vinyl alcohol polymer.

In another type of closure, the container body is usually a can and part of the closure is a removable panel. For instance the main panel of a can end may be of metal whilst a smaller area within the main panel, and defining part of the main panel, may be removable by pulling or pushing and may be of polymeric matrix material. For instance there may be a polymeric pull tab component set within a main metal panel. There may be an inner layer of polymeric material applied over the metal surface, for instance to promote bonding of the removable polymeric panel to it. This inner layer may be formed by depositing a fluid or molten composition over the metal (as described in copending application GB 8815486.9. Preferably, in the invention the removable polymeric panel is formed of the polymeric matrix containing ethylene vinyl alcohol polymer. Examples of closures having a removable panel of polymeric material, and to which the invention can be applied, are given in GB 2,180,521, 2,158,383 and 2,158,423 and in EP 153068 and 215671.

Removable panels, preformed discs or other elements for use in the invention may be formed by moulding thermoplastic compositions as discussed above for use in the manufacture of caps.

The essential feature of the invention is that the composition from which the cap is formed contains ethylene vinyl alcohol polymer in an amount and form such that the oxygen permeability of the cap is reduced. The reduction can be very significant, e.g., usually at least 5%, often at least 10% and frequently above 15 or 20%, often as much as 50% or more of the oxygen permeability of the same composition but in the absence of ethylene vinyl alcohol. The permability to other contaminating vapours is also reduced.

The amount of ethylene vinyl alcohol polymer is usually in the range 5 to 50%, based on the weight of the other polymeric components. Amounts in the range 10 to 35%, preferably 20 to 30%, are often preferred.

The ethylene vinyl alcohol polymer preferably has a melt index (in g/10 min measured at 190° C., 2160 g) in the range 1 to 15, often 4 to 10, most preferably 4 to 7. It typically has an ethylene content of 20 to 60%, generally 30 to 50%. Preferably the ethylene content is above 40%. The melting point of the polymer is generally in the range 150° to 180° C., preferably 160° to 170° C. The degree of hydrolysis of the polymer (from polyvinyl acetate) is generally above 95%.

The oxygen transmission rate of the polymer (measured at 35° C., dry, in cc.15 $\mu m/m^2$.24hrs.atm) is generally below 10 and preferably below 5. The water vapour transmission rate (measured at 40° C., 90% RH in g.30 $\mu m/m^2$.24hrs) is generally below 50, preferably from 10 to 40.

These ethylene vinyl alcohol polymer are especially suitable when, as is preferred, the cap is moulded from polypropylene.

Although in some instances a composition that gives reduced permeability can be obtained merely by simple melt blending of the matrix polymer and the ethylene vinyl alcohol polymer, it is often found that the blend with polypropylene or other matrix polymer may have increased permeability. This indicates that proper distribution of the components of the blend has not been achieved and the blend may be non-homogeneous. Under these circumstances, the desired reduction in permeability can usually be achieved merely by increasing the shear applied during the mixing. Additionally (or in some instances alternatively) the permeability can be reduced by inclusion of a tie resin. Suitable tie resins for this purpose are materials of the type known for promoting bonding of polymeric films, especially a film of ethylene vinyl alcohol with a film of polymeric matrix material. The amount of tie resin typically is 2 to 10%, based on the weight of matrix polymer. Suitable tie resins are often based on ethylene vinyl acetate or modified polypropylene. Accordingly, once it is found that the simple blend gives worse permeability, the materials should not be abandoned but they should be blended further and/or with a tie resin. Routine experimentation within these guidelines will show how to obtain the desired permeability despite the initial contra-indication.

By the invention it is possible to greatly prolong the shelf life of the beer or other content of the sealed jar or bottle. For instance the shelf life may be increased by 50% or more.

The following are examples.

EXAMPLE 1

A cap-forming composition is formed of polypropylene with 20% ethylene vinyl alcohol blended into it. The ethylene vinyl alcohol polymer has an ethylene content of 44%, melting point 164° C., melt index 5.5, density 1.14, oxygen transmission rate about 3 to 5 and water vapour transmission rate about 15 to 30 (the measurement conditions and units all being as defined above).

The permeability of a cap injection moulded from it is 120 cc/sq.m/day when the blending is by conventional melt blending. This is about the same as the permeability of the polypropylene alone.

When the degree of shear during the melt blending is increased significantly, the permeability drops to 80.

When 6pbw of an ethylene vinyl acetate tie resin are incorporated, the permeability is about 85, both with conventional blending and with high shear blending.

EXAMPLE 2

A cap formed by high shear mixing of polypropylene and ethylene vinyl alcohol, as in Example 1, has a gasket moulded in it from a composition of 85 parts low density polyethylene, 15 parts ethylene propylene elastomer and 20 parts ethylene vinyl alcohol. The cap is used for sealing a beer bottle. The beer has a better shelf life than when the cap and gasket are both free of the ethylene vinyl alcohol.

It is claimed:

1. A plastic container closure consisting of a polymer matrix formed of polypropylene and an ethylene vinyl alcohol polymer present in an amount and mixed in such fashion so as to reduce oxygen permeability of the matrix by at least 5%.

2. The closure of claim 1 wherein the closure has an oxygen transmission rate (measured at 350° C., dry, in cc. 15 mm/m$^2$.24 hrs. atm.) of below 10 and a water vapour transmission rate (measured at 40° C., 90% RH in g. 30 mm/m$^2$.24 hrs.) of below 50.

3. The closure of claim 2 wherein the oxygen transmission rate is below 5 and the water vapour transmission rate is from 10 to 40.

4. The closure of claim 1 wherein the ethylene vinyl alcohol polymer has a melt index (g/10 min measured at 190° C., 2160 g) in a range of about 1 to 15.

5. The closure of claim 1 wherein the ethylene vinyl alcohol polymer has an ethylene content of 30 to 50% and a melting point of 150° to 180° C.

6. The closure of claim 1 wherein the amount of the ethylene vinyl alcohol polymer is from 5 to 50% by weight of the polymer matrix and has a reduction in oxygen permeability of at least 5%.

7. A plastic closure consisting of a polymeric matrix of polypropylene, an ethylene vinyl alcohol copolymer and from about 2 to about 10% by weight of the matrix of a tie resin selected from the group consisting of ethylene vinyl acetate and modified polypropylene, the oxygen permability of the matrix being reduced by at least 5%.

8. The closure of claim 7 wherein the container closure is fitted to a filled container body.

9. The closure of claim 8 wherein the container body is of metal or glass.

10. The closure of claim 8 wherein the container body is of polymeric material.

11. The closure of claim 7 wherein the closure is moulded from polypropylene and an ethylene vinyl alcohol copolymer.

12. A plastic closure consisting of a polymeric matrix of, polypropylene, and from about 5% to about 50% by weight of the composition of an ethylene vinyl alcohol polymer having an ethylene content of from about 30 to about 50% a melting point of 150° to 180° C., and a melt index (g/10 min measured at 190° C., 216° g) in the range of from about 1 to about 15 the oxygen permability of the matrix being reduced by at least 5%.

13. The closure of claim 12 wherein the closure is fitted to a filled container body.

14. The closure of claim 13 wherein the filled container body is of metal or glass.

* * * * *